United States Patent [19]

Hamilton

[11] 4,442,638

[45] Apr. 17, 1984

[54] SHELF BRACKET

[76] Inventor: Luke C. Hamilton, R.R. #1 - Box 77, Bancroft, Iowa 50517

[21] Appl. No.: 390,786

[22] Filed: Jun. 21, 1982

[51] Int. Cl.[3] ..... E04G 3/00

[52] U.S. Cl. ..... 52/36; 403/232.1; 248/250; 248/218.4; 52/648

[58] Field of Search ..... 52/36, 648, 702, 703; 211/186, 207, 193; 403/232.1; 248/250, 235, 218.4

[56] References Cited

U.S. PATENT DOCUMENTS 3,473,774 10/1969 Riblet .

*Primary Examiner*—John E. Murtagh
*Assistant Examiner*—Kathryn L. Ford
*Attorney, Agent, or Firm*—Zarley, McKee, Thomte, Voorhees & Sease

[57] ABSTRACT

A shelf bracket is disclosed which is adapted to be attached to a rectangular pole structure. The bracket is comprised of a pair of spaced parallel arms having inner and outer ends which are adapted to embrace the side of the pole upon which the bracket is mounted. A fixed cross member extends laterally between the arms and is adapted to engage the forward or outer face of the pole. A fastening means detachably extends between said arms at the inner ends thereof. A pair of sockets is mounted on the outer side of each arm and is adapted to receive the ends of a stringer member for purposes of supporting a shelf surface. The upper ends of the sockets terminate in the plane of the upper portions of the arms.

3 Claims, 5 Drawing Figures

SHELF BRACKET

BACKGROUND OF THE INVENTION

Pole buildings are very common on the farms and ranches of America. They generally are comprised of a plurality of vertical poles. Horizontal stringer members extend between the poles, and skin material, usually corrugated metal, is then secured to the stringer members.

Such pole buildings often house machinery and the like and it is very desirable to have shelves in these buildings. However, it is difficult to construct a sturdy shelf in such buildings without substantial bracing that extends downwardly therefrom. Such braces often interfere with the storage of machinery and other material.

It is also difficult to build shelves in such buildings wherein varying widths and lengths for the storing of different items can be easily accommodated.

It is, therefore, an object of this invention to provide a shelf structure which is specifically adapted for use in pole buildings.

It is a further object of this invention to provide a shelf bracket which does not require any underpinning or bracing.

It is a still further object of this invention to provide a shelf bracket wherein shelves of varying sizes, and strength can be easily accommodated.

It is a still further object of this invention to provide a shelf bracket for pole buildings which can be easily installed, and which can be easily removed if necessary.

These and other objects will be apparent to those skilled in the art.

BRIEF SUMMARY OF THE INVENTION

The shelf bracket of this invention is comprised of a pair of spaced parallel arms having inner and outer ends and being adapted to embrace the sides of a rectangular pole adjacent their inner ends. A fixed cross member extends laterally between the arms and is adapted to engage the outer face of the pole. A fastening means detachably extends adjacent the inner face of the pole and is secured to the inner ends of the arms. A pair of socket members is mounted on each of the arms and is adapted to receive the end of stringer members which support a horizontal shelf surface. The upper ends of the sockets are in the plane of the upper portions of the arms.

DESCRIPTION OF THE PREFERRED EMBODIMENT

Figure 1:
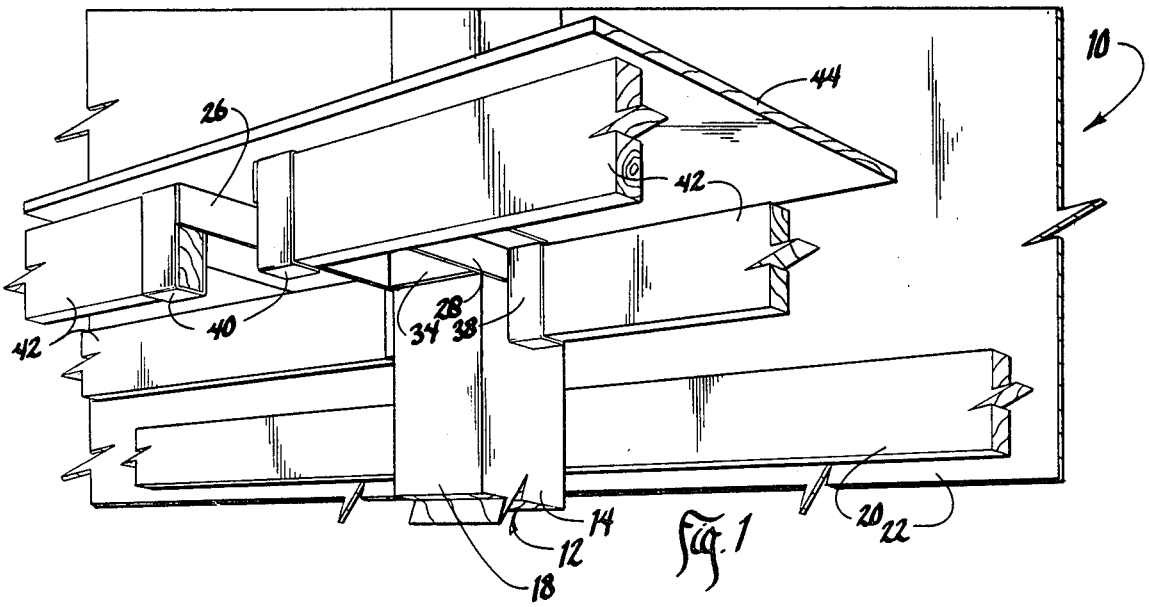
FIG. 1 is a bottom perspective view of a shelf erected using the shelf bracket of this invention.
Figure 2:
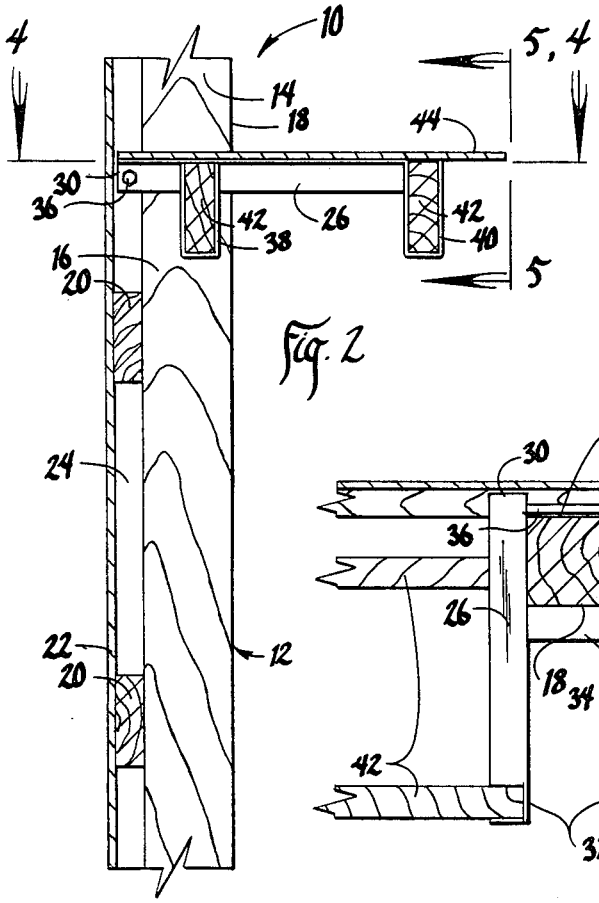
FIG. 2 is a sectional view through the wall of a pole building wherein the shelf bracket of this invention is used to support a shelf structure.
Figure 4:
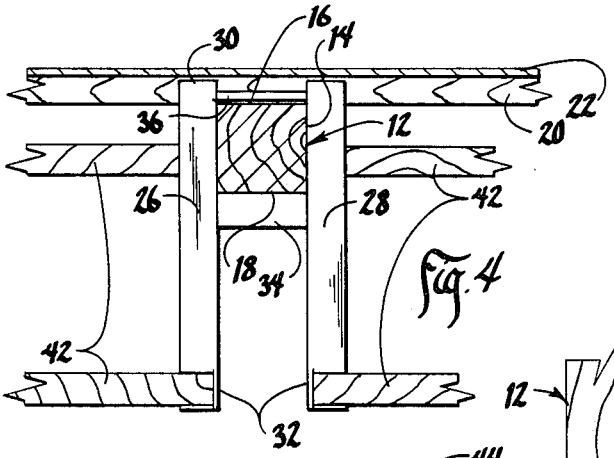
FIG. 4 is a sectional view taken on line 4—4 of FIG. 2.

The numeral 10 generally designates a conventional pole building which comprises a plurality of vertically disposed poles 12. Each pole has parallel sides 14, an inner face 16 (See FIG. 2), and an outer face 18. A plurality of spaced apart horizontal stringers 20 are nailed or otherwise secured to the inner face of the poles. A conventional skin material 22, normally comprised of corrugated metal, is then nailed or otherwise secured to the stringers 20. It should be noted that a narrow space 24 (See FIGS. 2 and 4) exits between the skin 22 of the inner face 16 of the poles.

Figure 3:
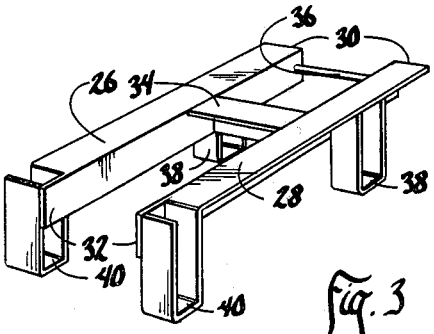
FIG. 3 is a perspective view at a reduced scale of the shelf bracket of this invention.

The bracket of this invention is best shown in FIG. 3 and is comprised of parallel spaced apart arms 26 and 28 which are mirror images of each other. Each arm has inner ends 30, outer ends 32, and a fixed cross brace 34 which extends between the arms at a short distance away from the inner ends thereof. Brace 34 is adapted to engage the outer face 18 of pole 12. A nut and bolt assembly 36 extends through suitable apertures (not shown) in the inner ends 30 of arms 26 and 28. This nut and bolt fastening means 36 extends through the space 24 between the skin material 22 and the inner face 16 of the pole 12.

Each of the arms 26 and 28 has two sockets secured thereto. An inner socket 38 is located towards the inner ends of the arms, and an outer socket 40 is mounted on the outer ends of the arms. It should be noted that the upper portions of the sockets terminate in the planes defined by the upper portions of the arms 26 and 28.

The sockets 38 and 40 normally have a vertical depth equal to the width of conventional lumber cut two inches by four inches or two inches by six inches. Such lumber serves as stringers 42 which have their ends mounted in each of the sockets and extend between the sockets of adjacent shelf brackets. Shelving material 44 is secured by nails or the like to the upper surfaces of the stringers 42. It should be noted that the shelving material 44 can be cut and fit around the posts 12 without any interruption in the shelving material. This is because the upper portions of the stringers 42 dwell in the same planes as the upper portions of the arms 26 and 28.

Figure 5:
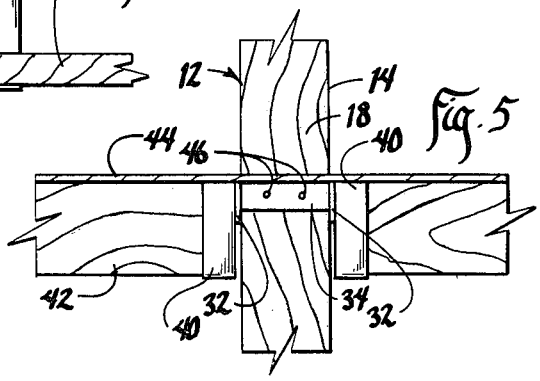
FIG. 5 is an elevational view seen on line 5—5 of FIG. 2.

If desired, nails or lag screws 46 can be inserted through suitable apertures in cross brace 34 as shown in FIG. 5.

As can be seen from the foregoing, the shelf brace of this invention requires no underpinning. It can be easily installed or easily removed, and is sufficiently durable to support objects of great weight.

It is, therefore, seen that this invention will achieve at least all of its stated objectives.

I claim:

1. The combination of a building wall comprised of a plurality of poles rectangular in cross-section and having two opposite sides, and an inner face and an outer face, parallel horizontal spaced stringers extending between said poles, and skin material secured to and extending over said stringers and being in close spaced relation to the inner faces of said poles and being separated therefrom by the width of said stringers, and a shelf structure, comprising, a shelf bracket secured to at least two of said poles, said shelf brackets each including a pair of spaced parallel arms having inner and outer ends and being adapted to embrace the sides of the respective poles upon which they are mounted, a fixed cross member extending laterally between said arms and being located away from the inner ends of said arms to engage the outer faces of said rectangular poles, a fastening means detachably secured to said arms and extending between said arms at the inner ends thereof adjacent the inner face of said poles and extending through a narrow space between the inner face of said poles and said skin material as defined by the thickness of said stringers, a pair of sockets on each of said arms adapted to receive the ends of second stringers to support a shelf surface, second stringers received in the adjacent sockets of adjacent shelf brackets, and a shelf surface secured to said second stringers.

2. The combination of claim 1 wherein one socket is mounted on the outer end of each of said arms of said shelf brackets, and a second socket is mounted inwardly thereof in spaced relation thereto.

3. A shelf bracket adapted to be attached to a rectangular pole structure comprising, a pair of spaced parallel arms having inner and outer ends and being adapted to embrace the sides of a rectangular pole adjacent their inner ends, a fixed cross member extending laterally between said arms and being located away from said inner ends of said arms to engage the outer face of a rectangular pole, a fastening means detachably secured to said arms and extending between said arms at the inner ends thereof, and on each of said arms adapted to receive the ends of stringers to support a shelf surface, with a plurality of sockets, one socket being mounted on the outer end of each of said arms, and a second socket being mounted inwardly thereof in spaced relation thereto.

* * * * *